United States Patent [19]

Burvall

[11] 4,133,151

[45] Jan. 9, 1979

[54] CONNECTING ELEMENT

[76] Inventor: Sten B. Burvall, Hjärtervägen 7, S-142 00 Trångsund, Sweden

[21] Appl. No.: 839,052

[22] Filed: Oct. 3, 1977

[30] Foreign Application Priority Data

Oct. 1, 1976 [SE] Sweden ..... 7610898

[51] Int. Cl.[2] ..... F16B 7/04

[52] U.S. Cl. ..... 52/93; 403/171

[58] Field of Search ..... 403/172, 176, 171, 305; 52/645, 646, 93; 182/185

[56] References Cited

U.S. PATENT DOCUMENTS

| | | | |
|---|---|---|---|
| 1,347,808 | 7/1920 | Franklin | 403/172 X |
| 3,740,084 | 6/1973 | Tellberg | 403/171 |

*Primary Examiner*—Andrew V. Kundrat

*Attorney, Agent, or Firm*—Pollock, Vande Sande & Priddy

[57] ABSTRACT

This invention relates to connecting elements for removably joining together frame members such as posts, braces, stays or the like. The connecting element consists of open-ended sleeves having a form which permits the insertion of twisted or bent frame members.

5 Claims, 3 Drawing Figures

CONNECTING ELEMENT

FIELD OF THE INVENTION

The present invention relates to connecting elements consisting of attachment means, in the form of open-ended sleeves for removably joining together frame members such as posts, braces, stays or the like. The sleeves have one or more rounded corners and/or concave sides for the purpose of providing support for a frame member that is twisted or bent.

BACKGROUND OF THE INVENTION

When square wooden frame members are fastened together by conventional connecting elements consisting of sleeves which have the same cross-sectional shape as the frame members, problems arise when one or both of the frame members are twisted and must be fitted with both ends into said sleeves. In prior art constructions, the respective locations of sleeves opposite each other presupposes a frame member which is wholly or at least substantially without twist.

If the sleeves receiving the frame members are of square cross-section, both their inner height and breadth must be larger than the respective dimensions of the frame member, so as to provide enough play for a predetermined, sufficient degree of twisting in the frame members. The disadvantage of such construction is that it provides excessive play for straight frame members, which therefore are poorly fastened.

At the other extreme, when the sleeve is circular in cross-section, the square frame member can be twisted to an unlimited extent and still have support with its corners against the inner walls of the sleeve. In this case, however, the frame members will be difficult to lock in position, and their corners are likely to be damaged by wear and pressure.

SUMMARY OF THE INVENTION

The foregoing problems are overcome by combining the square form with the round. The sleeve is made bigger and rounder in those areas where the corners of the frame member are to be located, while elsewhere the sleeve walls are bent inwardly against the plane sides of the frame member. Thus, the inner configuration of the sleeve, as seen in cross-section, consists of convex surfaces adjacent to the corners of the frame members and concave or plane surfaces adjacent to the plane surfaces of the frame member. This construction accommodates a comparatively high degree of twist but still provides secure fastening for frame members having different degress of twist.

The shape of the sleeve can also be described as the transverse cross-section described by the contour of the frame member when the latter is twisted within fixed limits around a predetermined axis of twist. Normally, the axis of twist is the same as the axis of symmetry. To facilitate the reception of somewhat bent frame members, the axis of twist should be perpendicular to the axis of symmetry of the frame member. This results in a somewhat conical form of the sleeve. Furthermore, at some points the sleeve is usually bigger than the generated transverse cross-section, to facilitate insertion of the frame member or securing means.

The larger the desired angle of twist about the axis of symmetry, the closer is the approach to a circular shape with its aforementioned drawbacks. Twist angles of about 90° or more demand a circular form of the sleeve.

Fortunately, in practice the twist of sawn wood is less, usually within 10° per running meter. By means of the present invention sleeves for larger twist angles are made feasible.

BRIEF INTRODUCTION TO THE DRAWINGS

An exemplary embodiment of the invention will now be described with reference to the accompanying drawings, in which FIG. 1 shows a frame structure joined together by connecting elements;

FIG. 2 is a perspective view of a connecting element according to the invention; and FIG. 3 is a cross-sectional view of FIG. 2, an open-ended sleeve according to the invention with an example of a securing means.

DESCRIPTION OF PREFERRED EMBODIMENTS

Figure 1:
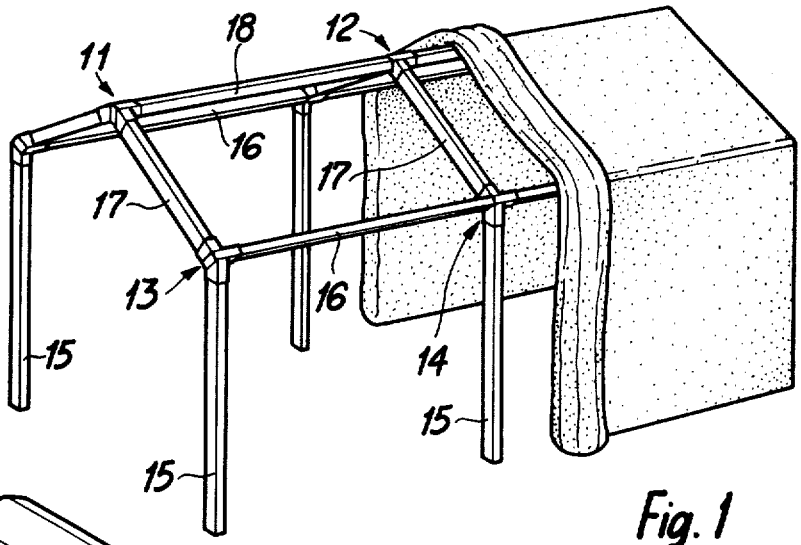

Shown in FIG. 1 is a frame structure which has been connected together by means of universal connecting elements 11, 12, 13 and 14, the frame structure being supported by posts 15. The twist angle of these posts is without importance as they are fastened at only one end. The twist angle of the frame members 16, 17 and 18 is however of importance, as the twist angle must be compensated by the inner shape of the sleeves of the connecting elements.

Figure 2:
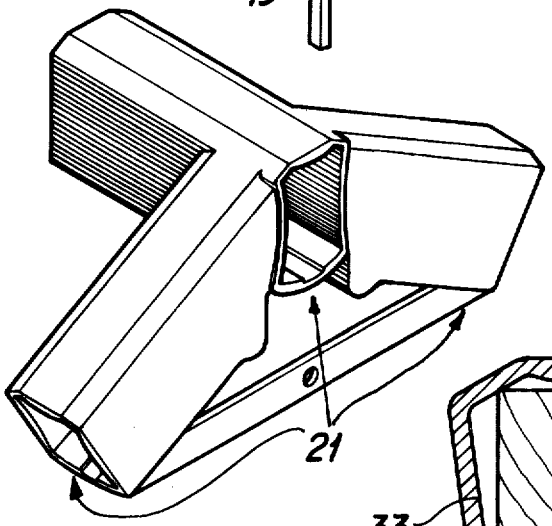
Figure 3:
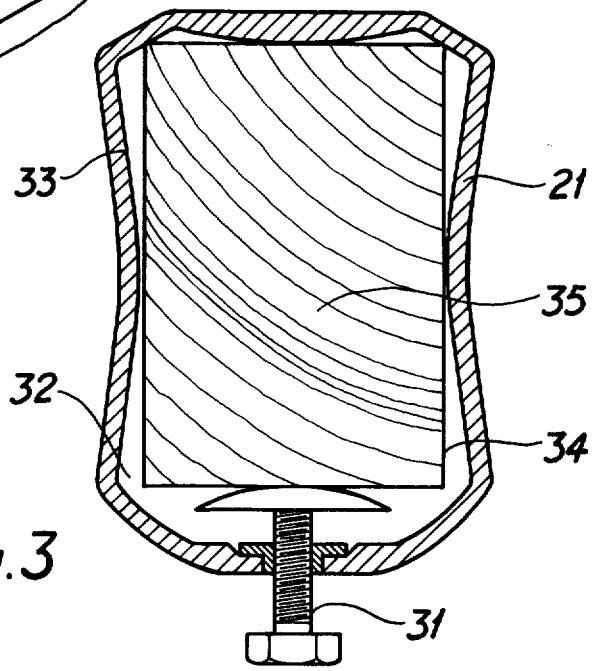

The universal connecting element shown in FIG. 2 is intended to couple together frame members 15, 16, 17 and 18 at all the joints of the frame structure, i.e., 11, 12, 13 and 14 in FIG. 1. It is provided with open-ended sleeves 21 which extend in different directions and which are intended to receive frame members according to the invention. Shown in FIG. 3 is a cross-section of a sleeve 21 with a form according to the invention, provided with means 31 for securing the inserted frame member in position. It will be noted that the transverse cross-section 33 of the sleeve, which the outer contour 34 of the frame member has made through the twist around its axis of symmetry 35, includes inner space 32 which also serves to accommodate the securing means.

What I claim is:

1. In a structural framework of the type comprising a plurality of separate, elongated frame members which are disposed in end to end relation to one another and which are oriented respectively in horizontal, vertical, and oblique directions to define different sections of said framework, the adjacent ends of said frame members being interconnected to one another by connecting elements at a plurality of junctions that are located respectively at the adjacent ends of groups of said frame members, said junction points and their associated connecting elements being disposed in spaced relation to one another throughout said framework, the improvement wherein the connecting elements consist of attachment means in the form of a hollow sleeve surrounding a said frame member and having a transverse cross-section comprising four sides and four corner portions, at least one of said sides being concave, and at least two of said corner portions being convex, said cross-section corresponding to the form generated by the outer contour of the frame member when the frame member within fixed limits is twisted around a predetermined axis of twist.

2. The improvement of claim 1, wherein at least one portion of the cross-section of said hollow sleeve is larger than the corresponding portion of said transverse cross-section of said frame member.

3. The improvement of claim 1, wherein the axis about which the frame member, for the generation of the transverse cross-section of the recess, is twisted, is the same as the axis of symmetry of the frame member.

4. The improvement of claim 1, wherein the axis about which the frame member, for the generation of the transverse cross-section of the recess, is twisted, is perpendicular to the axis of symmetry of the frame member.

5. The improvement of claim 1, wherein said hollow sleeve has two longer and two shorter sides, at least one of said longer sides being concave.

* * * * *